US010218067B2

(12) United States Patent
Black et al.

(10) Patent No.: US 10,218,067 B2
(45) Date of Patent: Feb. 26, 2019

(54) TUNABLE METAMATERIAL SYSTEMS AND METHODS

(71) Applicant: Elwha LLC, Bellevue, WA (US)

(72) Inventors: Eric J. Black, Bothell, WA (US); Brian Mark Deutsch, Snoqualmie, WA (US); Alexander Remley Katko, Bellevue, WA (US); Melroy Machado, Seattle, WA (US); Jay Howard McCandless, Alpine, CA (US); Yaroslav A. Urzhumov, Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 264 days.

(21) Appl. No.: 14/918,331

(22) Filed: Oct. 20, 2015

(65) Prior Publication Data

US 2017/0069966 A1 Mar. 9, 2017

Related U.S. Application Data

(60) Provisional application No. 62/214,836, filed on Sep. 4, 2015.

(51) Int. Cl.
*H01Q 3/26* (2006.01)
*H01Q 3/00* (2006.01)

(52) U.S. Cl.
CPC ..... *H01Q 3/26* (2013.01)

(58) Field of Classification Search
CPC ..... H01Q 3/26; H01Q 1/36; H01Q 15/0086; H01Q 3/30
See application file for complete search history.

(56) References Cited

U.S. PATENT DOCUMENTS 5,441,532 A 8/1995 Fenn
6,492,942 B1 * 12/2002 Kezys ..... H01Q 3/26
6,533,733 B1 3/2003 Ericson et al.
6,876,337 B2 4/2005 Larry
6,879,693 B2 4/2005 Miller et al.
7,256,753 B2 * 8/2007 Werner et al. ..... H01Q 15/0086
(Continued)

OTHER PUBLICATIONS

Driscoll et al., Performance of a three dimensional transformation-optical-flattened Luneburg lens, Optics Express, Jun. 4, 2012, vol. 20 No. 12, Optical Society of America.
(Continued)

*Primary Examiner* — Bernarr E Gregory

(57) ABSTRACT

The present disclosure provides system and methods for optimizing the tuning of impedance elements associate with sub-wavelength antenna elements to attain target radiation and/or field patterns. A scattering matrix (S-Matrix) of field amplitudes for each of a plurality of modeled lumped ports, N, may be determined that includes a plurality of lumped antenna ports, $N_a$, with impedance values corresponding to the impedance values of associated impedance elements and at least one modeled external port, $N_e$, located external to the antenna system at a specified radius vector. Impedance values may be identified through an optimization process, and the impedance elements may be tuned (dynamically or statically) to attain a specific target radiation pattern.

35 Claims, 10 Drawing Sheets

(56) References Cited

U.S. PATENT DOCUMENTS

| | | | | |
|---|---|---|---|---|
| 7,924,226 | B2 | 4/2011 | Soler Castany et al. | |
| 7,928,900 | B2 * | 4/2011 | Fuller | H01Q 15/0086 342/175 |
| 8,471,776 | B2 * | 6/2013 | Das | H01Q 3/30 |
| 8,504,138 | B1 | 8/2013 | Pivonka et al. | |
| 8,776,002 | B2 * | 7/2014 | Formato | H01Q 1/36 |
| 8,847,840 | B1 | 9/2014 | Diaz | |
| 9,252,492 | B2 | 2/2016 | Alrabadi et al. | |
| 9,917,376 | B2 | 3/2018 | Belmkaddem et al. | |
| 2003/0011515 | A1 | 1/2003 | Warble et al. | |
| 2003/0048223 | A1 * | 3/2003 | Kezys | H01Q 3/26 |
| 2004/0162034 | A1 | 8/2004 | Parker | |
| 2004/0201526 | A1 | 10/2004 | Knowles et al. | |
| 2007/0288066 | A1 | 12/2007 | Christman et al. | |
| 2008/0015421 | A1 | 1/2008 | Penner | |
| 2009/0284431 | A1 | 11/2009 | Meharry et al. | |
| 2010/0022861 | A1 | 1/2010 | Cinbis et al. | |
| 2010/0136926 | A1 | 6/2010 | Lackey | |
| 2010/0262160 | A1 | 10/2010 | Boyden et al. | |
| 2010/0262239 | A1 | 10/2010 | Boyden et al. | |
| 2010/0301971 | A1 | 12/2010 | Yonak et al. | |
| 2010/0324378 | A1 | 12/2010 | Tran et al. | |
| 2011/0086598 | A1 | 4/2011 | Ali et al. | |
| 2011/0087306 | A1 | 4/2011 | Goossen | |
| 2011/0260920 | A1 | 10/2011 | Dybdal et al. | |
| 2013/0154558 | A1 | 6/2013 | Lee et al. | |
| 2014/0039277 | A1 | 2/2014 | Abraham | |
| 2014/0056378 | A1 | 2/2014 | Harel et al. | |
| 2014/0306784 | A1 | 10/2014 | Broyde et al. | |
| 2014/0334565 | A1 | 11/2014 | Tzanidis et al. | |
| 2014/0340278 | A1 * | 11/2014 | Formato | H01Q 1/36 |
| 2014/0340732 | A1 | 11/2014 | Zhang et al. | |
| 2015/0130285 | A1 | 5/2015 | Leabman et al. | |
| 2015/0171516 | A1 | 6/2015 | Chen et al. | |
| 2016/0074196 | A1 | 3/2016 | Forsell | |
| 2016/0344240 | A1 | 11/2016 | Yeh et al. | |
| 2017/0063344 | A1 | 3/2017 | Broyde et al. | |
| 2017/0063439 | A1 | 3/2017 | Frank | |
| 2017/0356980 | A1 | 12/2017 | Islam et al. | |

OTHER PUBLICATIONS

Larouche et al., Nanotube holograms, Nature, Nov. 1, 2012, pp. 47-48, vol. 491, Macmillan Publishers Limited.
Landy et al., A full-parameter unidirectional metamaterial cloak for microwaves, Nature Materials, Nov. 11, 2012, pp. 1-4, Macmillan Publishers Limited.
Hunt et al., Broadband Wide Angle Lens Implemented with Dielectric Metamaterials, www.mdpi.com/journal/sensors Aug. 12, 2011, pp. 7982-7991.
Larouche et al., Infrared metamaterial phase holograms, Nature Materials, Mar. 18, 2012, pp. 450-454, vol. 11.
Hunt et al., Planar, flattened Luneburg lens at infrared wavelengths, Optics Express, Jan. 16, 2012, pp. 1706-1713, vol. 20 No. 2, Optical Society of America.
Urzhumov et al., Thin low-loss dielectric coatings for free-space cloaking, Optics Letters, May 15, 2013, pp. 1606-1608, vol. 38 No. 10, Optical Society of America.
Urzhumov et al., Low-loss directional cloaks without superluminal velocity or magnetic response, Optics Letters, Nov. 1, 2012, pp. 4471-4473, vol. 37 No. 21, Optical Society of America.
Ni et al., Metasurface holograms for visible light, Nature Communications, Nov. 15, 2013, pp. 1-6, Macmillan Publishers Limited.
Leon-Saval et al., Mode-selective photonic lanterns for space-division multiplexing, Optics Express, Jan. 13, 2014, pp. 1-9, vol. 22 No. 1, Optical Society of America.
Lalau-Keraly et al., Adjoint shape optimization applied to electromagnetic design, Optics Express, Sep. 9, 2013, pp. 21693-21701, vol. 21 No. 18, Optical Society of America.
Lin et al., Nanostructured Holograms for Broadband Manipulation of Vector Beams, Nano Letters, Aug. 5, 2013, pp. 4269-4274, American Chemical Society.
Jin et al., Advances in Particle Swarm Optimization for Antenna Designs: Real-Number, Binary, Single-Objective and Multiobjective Implementations, IEEE Transactions on Antennas and Propagation, Mar. 2007, pp. 556-567, vol. 55 No. 3, IEEE.
Zhu et al., Design and Optimization of Low Rcs Patch Antennas Based on a Genetic Algorithm, Progress in Electromagnetics Research, 2012, pp. 327-339, vol. 122.
Wu et al., Design Synthesis of Metasurfaces for Broadband Hybrid-Mode Horn Antennas With Enhanced Radiation Pattern and Polarization Characteristics, IEEE Transactions on Antennas and Propagation, Aug. 2012, pp. 3594-3604, vol. 60 No. 8, IEEE.
Boeringer et al., Efficiency-Constrained Particle Swarm Optimization of a Modified Bernstein Polynomial for Conformal Array Excitation Amplitude Synthesis, IEEE Transactions on Antennas and Propagation, Aug. 2005, pp. 2662-2673, vol. 53 No. 8, IEEE.
Yu et al., Flat optics with designer metasurfaces, Nature Materials, Jan. 23, 2014, pp. 139-150, vol. 13, Macmillan Publishers Limited.
Jensen et al., Topology optimization for nano-photonics, Laser Photonics, 2011, pp. 308-321, Rev 5 No. 2, Wiley-Vhe Verleg GmbH & Co.
Orihara et al., Optimization and application of hybrid-level binary zone plates, Applied Optics, Nov. 10, 2001, pp. 5877-5885, vol. 40 No. 32, Optical Society of America.
Seliger et al., Optimization of aperiodic dielectric structures, http://dx.doi.org/10.1063/1.2221497, Aug. 8, 2006, visited Aug. 11, 2014.
Toader et al., Photonic Band Gap Architectures for Holographic Lithography, Physical Review Letters, Jan. 30, 2004, pp. 1-4, vol. 92 No. 4, The American Physical Society.
Sharp et al., Photonic crystals for the visible spectrum by holographic lithography, Optical and Quantum Electronics 34, 2002, pp. 3-12, Kluwer Academic Publishers.
Fong et al., Scalar and Tensor Holographic Artificial Impedance Surfaces, IEEE Transactions on Antennas and Propagation, Oct. 2010, pp. 3212-3221, vol. 58 No. 10, IEEE.
Kildishev et al., Planar Photonics with Metasurfaces, Science 339, http://www.sciencemag.org/content/339/6125/1232009.full.html, Mar. 15, 2013, visited Oct. 8, 2014.
Saravanamuttu et al., Sol-Gel Organic-Inorganic Composites for 3-D Holographic Lithography of Photonic Crystals with Submicron Periodicity, American Chemical Society, Apr. 29, 2003, 4 pgs.
Bayraktar et al., The Design of Miniature Three-Element Stochastic Yagi-Uda Arrays Using Particle Swarm Optimization, IEEE Antennas and Wireless Propagation Letters, Nov. 22, 2005, pp. 22-26, IEEE.
Miller, Photonic Design: From Fundamental Solar Cell Physics to Computational Inverse Design, Thesis, Spring 2012, pp. 137.
Huang et al., Three-dimensional optical holography using a plasmonic metasurface, Nature Communications, Nov. 15, 2013, pp. 1-8, Macmillan Publishers Limited.
Yu et al., Topology optimization for highly-efficient light-trapping structure in solar cells, Research paper, May 10, 2014, pp. 367-382, Springer-Verlag Berlin Heidelberg 2014.
PCT International Search Report; International App. No. PCT/US2016/049965; dated Dec. 8, 2016; pp. 1-3.
Zhang et al.; "Optimal Load Analysis for a Two-Receiver Wireless Power Transfer System"; Wireless Power Transfer Conference (WPTC), 2014 IEEE 2014; pp. 84-87.

* cited by examiner

TUNABLE METAMATERIAL SYSTEMS AND METHODS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc., applications of such applications are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc., applications of the Priority Application(s)). In addition, the present application is related to the "Related Applications," if any, listed below.

PRIORITY APPLICATIONS

This application claims priority under 35 U.S.C. § 119(e) to Provisional Patent App. No. 62/214,836, filed on Sep. 4, 2015, titled "Tunable Metamaterial Devices and Methods for Selecting Global Optima in Their Performance," which application is hereby incorporated by reference in its entirety.

RELATED APPLICATIONS

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc., applications of the Priority Applications and the Related Applications, including any priority claims, is incorporated herein by reference to the extent such subject matter is not inconsistent herewith.

TECHNICAL FIELD

This disclosure relates to tunable metamaterial devices and the optimization of variable impedance elements to attain target radiation and/or field patterns.

SUMMARY

An antenna system may include a plurality of sub-wavelength antenna elements. Each of the sub-wavelength antenna elements may be associated with at least one variable impedance element. The impedance of one or more of the variable impedance elements may be adjusted through one or more impedance control inputs and/or during a manufacturing process. The number of sub-wavelength antenna elements, associated impedance elements, and/or impedance control inputs may be a 1:1:1 ratio or an X:Y:Z ratio, where X, Y, and Z are all integers that may or may not be equal. For instance, in one embodiment there may be a 1:1 mapping of impedance elements to sub-wavelength antenna elements, while there is only one-tenth the number of impedance control inputs.

One or more hardware, software, and/or firmware solutions may be employed to perform operations for radiation patterning by controlling, setting, and/or varying the impedance values of the lumped impedance elements via the one or more impedance control inputs. For instance, a computer-readable medium (e.g., a non-transitory computer-readable medium) may have instructions that are executable by a processor to form a specific radiation pattern. The executed operations or method steps may include determining a scattering matrix (S-Matrix) of field amplitudes (e.g., electric field amplitudes) for each of a plurality of lumped ports, N, used to model the antenna system. The lumped ports, N, may include a plurality of lumped antenna ports, $N_a$, with impedance values corresponding to the impedance values of each of a plurality of lumped impedance elements. The lumped ports, N, include at least one external port, $N_e$, that is located physically external to the antenna system.

The S-Matrix is expressible in terms of an impedance matrix, Z-Matrix, with impedance values, $z_n$, associated with the plurality of lumped ports, N. By modifying one or more of the impedance values, $z_n$, associated with one or more of the plurality of lumped ports, N, a desired S-Matrix of target field amplitudes can be attained. A target radiation pattern of the antenna system may be defined in terms of one or more target field amplitudes in the S-Matrix for one or more lumped external ports, $N_e$.

An optimized port impedance vector $\{z_n\}$ of impedance values $z_n$ for each of the lumped antenna ports, $N_a$, may be calculated that results in S-Matrix elements for the one or more lumped external ports, $N_e$, that approximates the target field amplitude, for a given operating frequency. Once an optimized $\{z_n\}$ is identified that will result in the desired field amplitude values for the S-Matrix elements of the one or more lumped external ports, $N_e$, the variable impedance control inputs may be adjusted as necessary to attain the optimized $\{z_n\}$.

DETAILED DESCRIPTION

Figure 1:
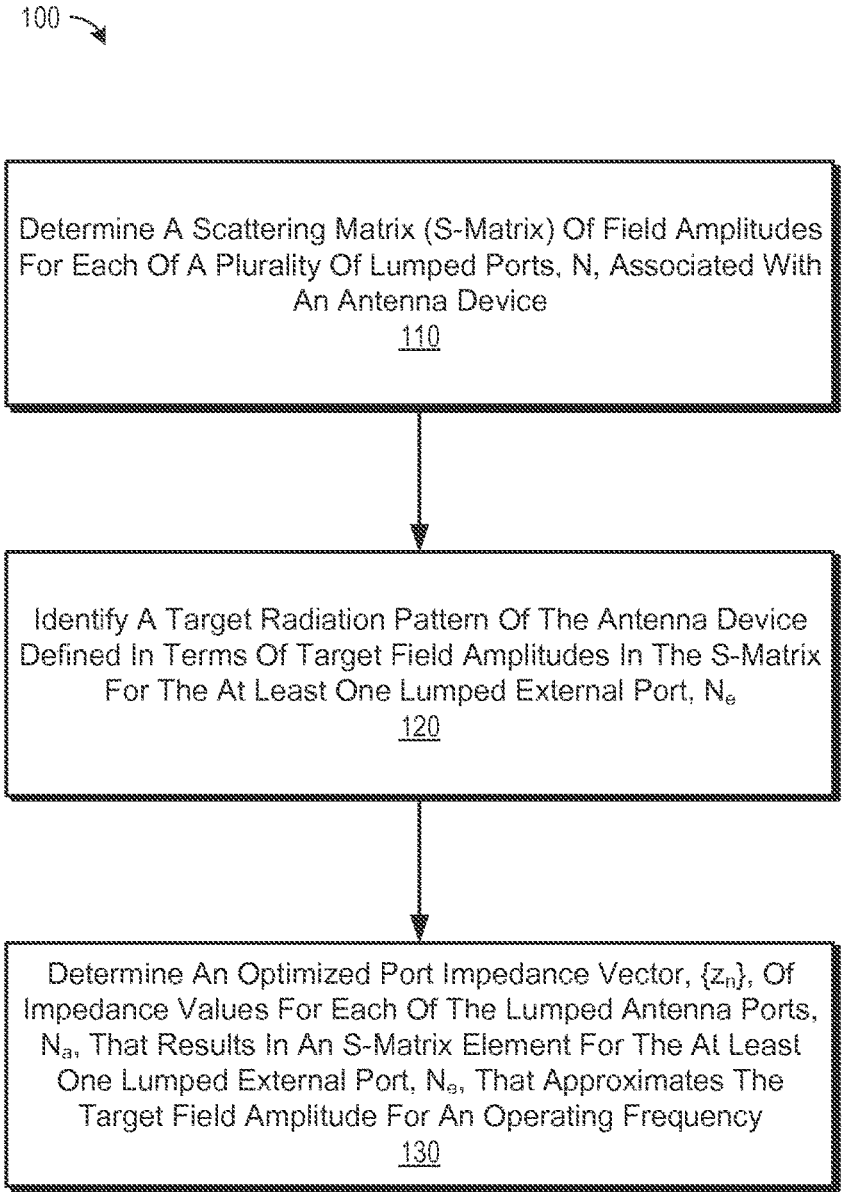
FIG. 1 is a flow chart of one embodiment of a method for radiation patterning by optimizing variable impedance values associated with an S-Matrix that includes at least one lumped port external to an antenna system.

Various embodiments, systems, apparata, and methods are described herein that relate to radiation and electromagnetic field patterning. Tunable metamaterial devices may be used to solve various electromagnetic field-based issues. By tuning individual elements of a densely packed metamaterial array, a wide variety of customizable radiation patterns may be attained. In many instances of this disclosure metamaterial elements are used as example embodiments of sub-wavelength antenna elements. It is, however, appreciated that any of a wide variety of sub-wavelength antenna elements may be utilized that may or may not be classified as metamaterials.

Optimizing the tuning of the individual sub-wavelength antenna elements or groups of elements to attain a target radiation pattern may be done in a wide variety of manners. Many of these approaches, however, result in one or a small number of potential tuning solutions, without giving any assurance that any of these solutions represent the best solution (global optimum) and/or without providing any indication of how close to the global optimum the solution might be. Exhaustive computations using traditional methods may be too computationally intensive and/or infeasible for real-time tuning and for switching.

The complexity of the optimization problem may increase rapidly with the complexity of the device. In many embodiments, the complexity increases exponentially with the number of tunable or selectable elements. Thus, standard optimization approaches for tuning elements of an array of sub-wavelength antenna elements may require cost functions to be evaluated a large number of times. The number of tunable elements of the antenna system may be expressed as the degrees of freedom (DoF) of an antenna device. The DoF may be based on the number of antenna elements, associated tunable elements, and/or other tunable or adjustable components associated with an antenna system. As the DoF increases, the complexity is likely to increase exponentially, leading to optimization problems for which global or even quasi-global solutions are prohibitively computationally expensive for even moderate device complexity.

The present systems and methods provide optimization solutions for arrays of antenna elements and associated tunable (i.e., variable) lumped impedance elements in which the optimization solutions are rational multivariate functions. Accordingly, globally optimal solutions may be found by solving optimization problems that scale linearly with the DoF. The optimization approach can be simplified by making the cost function dependent on one matrix-value input (such as an impedance matrix, Z-Matrix) that can be calculated by performing no more than N linear system simulations. In the present application, N is an integer corresponding to the number of variable (e.g., tunable) impedance elements associated with an antenna system.

The cost function, although still nonlinear, may have a specific rational form that permits exhaustive enumeration of all local extrema. A global maximum (or minimum) can be selected from the local extrema. For rational function, the extrema are found by solving multivariate polynomial equations. Root enumeration and/or numerical calculations of the multivariate polynomial equations may allow for specialized treatment.

Tunable metamaterials, including two-dimensional metasurface devices, may comprise an array of unit cells. Each unit cell may be modeled as a sub-wavelength antenna element associated with one or more variable impedance elements. Each variable impedance element may be associated with one or more sub-wavelength antenna elements. Each impedance element or group of impedance elements may be variably controlled based on one or more impedance control inputs. The tuning may be a one-time static tuning that is performed during the manufacturing of the antenna device, or the tuning may be a dynamic process that occurs during operation by modifying one or more control inputs.

As an example of static tunability, a metamaterial device may be manufactured using a 3D printer and the tuning may comprise selecting a material or combination of materials that results in a specific electromagnetic or electrical property for each of the impedance elements. By uniquely selecting the material or combination of materials for each of the unit cells, a metamaterial antenna device may be statically tuned to a specific radiation pattern. Alternatively, each unit cell may be modeled to include a lumped impedance element with (at least) one input and (at least) one output. The input(s) may be dynamically manipulated during operation to dynamically tune the antenna device in real-time to allow for a wide range of selectable target radiation patterns.

As previously described, the system may be modeled to include lumped impedance elements that can be passive, active, or variably passive-active. At a given frequency, each impedance element may be fully described by the complex value of its impedance "z." A positive integer N may be used to describe the number of tunable or variable lumped impedance elements in an antenna system. A diagonal square matrix of size N may have diagonal elements $z_n$ representative of the nth elements of the antenna system. Alternatively, an N-dimensional complex vector, $\{z_n\}$, can be used to represent the n-valued list of impedance values.

Each variable impedance element may be modeled as a port (e.g., a lumped port and/or a wave port). A plurality of lumped ports, N, may include a plurality of lumped antenna ports, $N_a$, with impedance values corresponding to the impedance values of each of the variable impedance elements, and at least one lumped external port, $N_e$, that may or may not have a variable impedance or any impedance at all. That is, the z value of the modeled lumped external port, $N_e$, may be zero and represent an idealized shorted port. Alternatively, the z value of the modeled lumped external port, $N_e$, may be infinity and represent an idealized open port. In many embodiments, the z value of the external port, $N_e$, may be a complex value with a magnitude between zero and infinity.

Regardless of the impedance values of each of the lumped ports, N, including the lumped antenna ports, $N_a$, and the at least one lumped external port, $N_e$, each of the lumped ports (or in some embodiments wave ports) may have its own self-impedance and the network of ports may be described by an N×N impedance matrix (Z-Matrix) or by the equivalent inverse admittance matrix (Y-Matrix) where $Y=Z^{-1}$. Additionally, the network of ports can be modeled as an S-parameter matrix or scattering matrix (S-Matrix). The Z-Matrix and its inverse the Y-Matrix are independent from the specific z values of the ports because the matrix elements are defined as $Z_{nm}=V_n/I_m$, where $V_n$ and $I_m$ are the voltage at port n and the current at port m, measured with all other ports open. That is, assuming port currents $I_k=0$ for all k not equal to m or n. Similarly, for the admittance matrix, $Y_{nm}=I_m/V_n$, measured with all other ports open. Again, that is assuming port currents $I_k=0$ for all k not equal to m or n.

The S-Matrix is expressible through the Z or Y matrices and the values of the lumped impedance elements as follows:

$$S=(\sqrt{y}Z\sqrt{y}-1)(\sqrt{y}Z\sqrt{y}+1)^{-1}=(1-\sqrt{z}Y\sqrt{z})(1+\sqrt{z}Y\sqrt{z})^{-1}$$

In the equation above, the "1" represents a unit matrix of size N. The S-Matrix models the port-to-port transmission of off-diagonal elements of the N-port antenna system. In a lossless system, the S-Matrix is necessarily unitary. If elements $s_n$ are the singular values of the S-Matrix, which are the same as the magnitudes of the eigenvalues, it can be stated that in a lossless system, all $s_n=1$. In general, if $s_{max}$ is the largest singular value, then for a passive lossy system it can be stated that $s_n \leq s_{max} \leq 1$.

In an active system, these bounds still hold, however $s_{max}$ can now exceed unity, representing an overall power gain for at least one propagation path. The Z and Y matrices are diagonalized in the same basis represented by a unitary matrix U ($U^\dagger=U^{-1}$), such that $Z=U^\dagger Z_d U$, $Y=U^\dagger Y_d U$, where the subscript d indicates a diagonal matrix, the elements of which are complex-valued eigenvalues of the corresponding matrix.

Generally speaking, unless $\sqrt{z}$ is proportional to a unit matrix (i.e., all lumped element impedances are equal), the S-Matrix will not be diagonal in the U-basis. In the U-basis, the general form of the S-Matrix is $S=U^\dagger(1-\zeta Y_d\zeta)(1+\zeta Y_d\zeta)^{-1}U$, where a new non-diagonal matrix $\zeta=U\sqrt{z}U^\dagger$ is used such that $\sqrt{z}=U^\dagger\zeta U$, and $Y_d$ is diagonal, though not generally commutative with $\zeta$.

The S-Matrix of the system can be numerically evaluated with any desired accuracy by solving exactly N linear system problems (e.g., Znm=Vn/Im or Ynm=Im/Vn and the associated open port conditions described above). Such problems may be solved with Finite Element Methods (FEM) or finite-difference time-domain (FDTD) based solvers for linear electromagnetic systems. Examples of commercially available solvers include ANSYS® HFSS®, COMSOL®, and CST®. These numerical simulations incorporate various fine effects of the near-field and far-field interactions between various parts of the system, regardless of complexity.

The Z-Matrix and/or the Y-Matrix can be evaluated based on a knowledge of the S-matrix and the impedance values. With many FEM solvers, it is also possible to directly evaluate the Z-Matrix or the Y-Matrix, by solving $N^2$ linear problems. This approach, however, is N times less efficient than calculating the S-Matrix with a fixed set of port impedance values (known as reference impedance values), and transforming it to Z and/or Y.

In various embodiments, an antenna system may include a plurality of sub-wavelength antenna elements. The sub-wavelength antenna elements may each have a maximum dimension that is less than half of a wavelength of the smallest frequency within an operating frequency range. One or more of the sub-wavelength antenna elements may comprise a resonating element. In various embodiments, some or all of the sub-wavelength antenna elements may comprise metamaterials. In other embodiments, an array of the sub-wavelength antenna elements (e.g., resonating elements) may be collectively considered a metamaterial.

The sub-wavelength antenna elements may have inter-element spacings that are substantially less than a free-space wavelength corresponding to an operating frequency or frequency range. For example, the inter-element spacings may be less than one-half or one-quarter of the free-space operating wavelength. The antenna system may be configured to operate in a wide variety of operating frequency ranges, including, but not limited to, microwave frequencies. The presently described systems and methods may be adapted for use with other frequency bands, including those designated as very low frequency, low frequency, medium frequency, high frequency, very high frequency, ultra-high frequency, superhigh frequency, and extremely high frequency or millimeter waves.

In some embodiments, each of the sub-wavelength antenna elements is associated with at least one lumped impedance element. A common transmission line (TL) may be coupled to the sub-wavelength antenna elements via the lumped impedance elements. Alternative waveguides may be used instead of or in addition to TLs. Each lumped impedance element may have a variable impedance value that may be at least partially based on the connected sub-wavelength antenna element(s) and/or a connected TL or other waveguide(s). A waveguide or TL may be modeled as another port in the S-Matrix in some embodiments, such as in Heretic-like architectures with variable couplers.

The impedance of each of the lumped impedance elements may be variably adjusted through one or more impedance control inputs. The number of sub-wavelength antenna elements, associated impedance elements, and the number of impedance control inputs may be a 1:1:1 ratio or an X:Y:Z, where X, Y, and Z are integers that may or may not be equal. For instance, in one embodiment there may be a 1:1 mapping of impedance elements to sub-wavelength antenna elements while there is only one-tenth the number of impedance control inputs.

In various embodiments, the modeled lumped external port, $N_e$, may or may not be associated with a variable impedance element. In some embodiments, the lumped external port, $N_e$, is modeled as an external port with an infinitesimal volume located at a particular radius-vector relative to the antenna device. The lumped external port, $N_e$, may be in the far-field of the antenna device, the radiative near-field of the antenna device, or the reactive near-field of the antenna device.

In some embodiments, the lumped external port, $N_e$, may comprise a virtual port, an external region of space assumed to be a void, a region of space assumed to be filled with a dielectric material, and/or a location in space assumed to be filled with a conductive, radiative, reactive, and/or reflective material. In at least some embodiments, the lumped external port, $N_e$, comprises a receiving antenna.

The lumped external port, $N_e$, may also be modeled as a virtual external port, comprises a field probe, as measured by a non-perturbing measurement. In other embodiments, the virtual external port may represent a numerical field probe, as calculated using a numerical simulation.

As previously described, in some embodiments, a unique lumped impedance element may be associated with each sub-wavelength antenna element. In other embodiments, a plurality of sub-wavelength antenna elements may be grouped together and associated with a single, variable, lumped impedance element. Conversely, a plurality of lumped impedance elements may be associated with a single sub-wavelength antenna element. In such an embodiment, the impedance of each of the plurality of lumped impedance elements may be controlled individually, or only some of them may be variable. In any of the above embodiments, X impedance control inputs may be varied to control the impedance of Y lumped impedance elements, where X and Y are integers that may or may not be equal.

As a specific example, 1,000 unique impedance control inputs may be provided for each of 1,000 unique lumped impedance elements. In such an embodiment, each of the impedance control inputs may be varied to control the impedance of each of the lumped impedance elements. As an alternative example, 1,000 unique lumped impedance elements may be controlled to be variably addressed by a binary control system with 10 inputs.

In some embodiments, one or more of the impedance control inputs may utilize the application of a direct current (DC) voltage to variably control the impedance of the lumped impedance element based on the magnitude of the applied DC voltage. In other embodiments, an impedance control input may utilize one or more of an electrical current input, a radiofrequency electromagnetic wave input an optical radiation input, a thermal radiation input, a terahertz radiation input, an acoustic wave input, a phonon wave input, a mechanical pressure input, a mechanical contact input, a thermal conduction input, an electromagnetic input, an electrical impedance control input, and a mechanical switch input. In various embodiments, the lumped impedance elements may be modeled as two-port structures with an input and an output.

The lumped impedance elements may comprise one or more of a resistor, a capacitor, an inductor, a varactor, a diode, a MEMS capacitor, a BST capacitor, a tunable ferroelectric capacitor, a tunable MEMS inductor, a pin diode, an adjustable resistor, an HEMT transistor, and/or another type of transistor. Any of a wide variety of alternative circuit components (whether in discrete or integrated form) may be part of a lumped impedance element.

One or more hardware, software, and/or firmware solutions may be employed to perform operations for radiation patterning by controlling the impedance values of the lumped impedance elements via the one or more impedance control inputs. For instance, a computer-readable medium (e.g., a non-transitory computer-readable medium) may have instructions that are executable by a processor to form a specific radiation pattern. The executed operations or method steps may include determining a scattering matrix (S-Matrix) of field amplitudes for each of a plurality of lumped ports, N.

The lumped ports, N, may include a plurality of lumped antenna ports, $N_a$, with impedance values corresponding to the impedance values of the plurality of physical impedance elements. In at least some embodiments, the modeled lumped ports, N, include at least one external port, $N_e$, that is located physically external to the antenna system. In some embodiments, the lumped ports, N, also include a TL or other waveguide as another lumped port for the calculation of the S-Matrix.

The S-Matrix is expressible in terms of an impedance matrix, Z-Matrix, with impedance values, $z_n$, of each of the plurality of lumped ports, N. Thus, by modifying one or more of the impedance values, $z_n$, associated with one or more of the plurality of lumped ports, N, a desired S-Matrix of field amplitudes can be attained. The operations or method steps may include identifying a target radiation pattern of the antenna system defined in terms of target field amplitudes in the S-Matrix for the at least one lumped external port, $N_e$.

An optimized port impedance vector $\{z_n\}$ of impedance values $z_n$ for each of the lumped antenna ports, $N_a$, may be calculated that results in S-Matrix elements for the one or more lumped external ports, $N_e$, that approximates the target field amplitude for a given operating frequency. Once an optimized $\{z_n\}$ is identified that will result in the desired field amplitude values for the S-Matrix elements of the one or more lumped external ports, $N_e$, the variable impedance control inputs may be adjusted as necessary to attain the optimized $\{z_n\}$.

As an example, a target field amplitude in the S-Matrix for a lumped external port, $N_e$, may correspond to a null in the field amplitude of the target radiation pattern. Alternatively, the target field amplitude in the S-Matrix for a lumped external port, $N_e$, may be maximized.

Any number of lumped external ports, $N_e$, may be used as part of the S-Matrix calculation. Using a plurality of lumped external ports, $N_e$, may allow for the definition of a radiation pattern having a plurality of side lobes, main lobes, and/or nulls. Thus, the S-Matrix may be calculated with a plurality of lumped external ports located external to the antenna device. The target field amplitudes in the S-Matrix for each of the lumped external ports may correspond to a target radiation pattern for the antenna device for a specific frequency range.

In various embodiments, at least one of the plurality of lumped antenna ports, $N_a$, is strongly mutually coupled to at least one other lumped antenna port, $N_a$. In some embodiments, at least one of the lumped external ports, $N_e$, is mutually coupled to one or more of the lumped antenna ports, $N_a$. Strongly mutually coupled devices may be those in which an off-diagonal Z-Matrix element $Z_{ij}$, is greater in magnitude than one-tenth of the $\max(|Z_{ii}|, |Z_{jj}|)$.

Determining an optimized $\{z_n\}$ may include calculating an optimized Z-Matrix using one or more of a variety of mathematical optimization techniques. For example, the optimized $\{z_n\}$ may be determined using a global optimization method involving a stochastic optimization method, a genetic optimization algorithm, a Monte-Carlo optimization method, a gradient-assisted optimization method, a simulated annealing optimization algorithm, a particle swarm optimization algorithm, a pattern search optimization method, a Multistart algorithm, and/or a global search optimization algorithm. Determining the optimized $\{z_n\}$ may be at least partially based on one or more initial guesses. Depending on the optimization algorithm used, the optimized values may be local optimizations based on initial guesses and may not in fact be true global optimizations. In other embodiments, sufficient optimization calculations are performed to ensure that a true globally optimized value is identified. In some embodiments, a returned optimization value or set of values may be associated with a confidence level or confidence value that the returned optimization value or set of values corresponds to global extrema as opposed to local extrema.

For gradient-assisted optimization, a gradient may be calculated analytically using an equation relating an S-parameter of the S-Matrix to the Z-Matrix and the optimized $\{z_n\}$. In some embodiments, a Hessian matrix calculation may be utilized that is calculated analytically using the equation relating the S-parameter to the Z-Matrix and the optimized $\{z_n\}$. A quasi-Newton method may also be employed in some embodiments. In the context of optimization, the Hessian matrix may be considered a matrix of second derivatives of the scalar optimization goal function with respect to the optimization variable vector.

In some embodiments, the global optimization method may include exhaustively or almost exhaustively determining all local extrema by solving a multivariate polynomial equation and selecting a global extrema from the determined local extrema. Alternative gradient-based methods may be used, such as conjugate gradient (CG) methods and steepest descent methods, etc. In the context of optimization, a gradient may be a vector of derivatives of the scalar optimization goal function with respect to the vector of optimization variables.

Exhaustively determining all local extrema may be performed by splitting the domain based on expected roots and then splitting it into smaller domains to calculate a single root or splitting the domain until a domain with a single root is found. Determining the optimized $\{z_n\}$ may include solving the optimization problem in which a simple case may include a clumped function scalar function with one output and N inputs. The N inputs could be complex $z_n$ values and the optimized Z-Matrix may be calculated based on an optimization of complex impedance values of the $z_n$ vectors.

The optimized $\{z_n\}$ may be calculated by finding an optimized Z-Matrix based on an optimization of complex impedance values $z_n$. The optimized $\{z_n\}$ may be calculated by finding an optimized Z-Matrix based on an optimization of roots of complex values of the impedance values $z_n$. The optimized $\{z_n\}$ may be calculated by finding an optimized Z-Matrix based on an optimization of reactances associated with the impedance values of the impedance values $z_n$. The optimized $\{z_n\}$ may be calculated by finding an optimized Z-Matrix based on an optimization of resistivities associated with the impedance values of the impedance values $z_n$. The optimization may be constrained to allow only positive or inductive values of reactances, or only negative or capacitive values of reactances. In other embodiments, the optimization of resistivities may be constrained to only allow for positive or passive values of resistivities.

The optimized $\{z_n\}$ may be calculated by finding an optimized Z-Matrix based on an optimization of the impedance control inputs associated with the lumped impedance elements of each of the sub-wavelength antenna elements. The optimized $\{z_n\}$ may be calculated by optimizing a nonlinear function. The nonlinear function may relate impedance values for each of the lumped antenna ports, $N_a$, as modeled in the S-Matrix and the associated impedance control inputs. In some embodiments, the nonlinear function may be fitted to a lower-order polynomial for optimization.

Mapping the Z-Matrix values to the S-Matrix values may comprise a non-linear mapping. In some instances, the mapping may be expressible as a single- or multivariate polynomial. The polynomial may be of a relatively low order (e.g., 1-5). The S-Matrix may comprise N values and the Z-Matrix may comprise M values, where N and M are both integers and equal to one another, such that there is a 1:1 mapping of S-Matrix values and Z-Matrix values. Any of a wide variety of mappings are possible. For example, the S-Matrix may comprise N values and the Z-Matrix may comprise M values, where N squared is equal to M. Alternatively, there may be a 2:1 or 3:1 mapping or a 1:3 or 2:1 mapping.

The physical location of the at least one lumped external port, $N_e$, may be associated with a single-path or multipath propagation channel that is electromagnetically reflective and/or refractive. The multipath propagation channel may be in the near-field. In a radiative near-field, the multipath propagation pattern may be in the reactive near-field.

As previously described, the field amplitudes in the S-Matrix may be used to define a target radiation pattern. In some embodiments, the target radiation pattern of the antenna device may be defined in terms of a target field amplitude for a single linear field polarization. The target radiation pattern may be defined in terms of a plurality of field amplitudes for a plurality of lumped external ports, $N_e$. The target radiation pattern may be defined in terms of a target field amplitude for at least two linear polarizations.

The target field amplitudes for one or more lumped external ports, $N_e$, may be selected to decrease far-field sidelobes of the antenna device, decrease a power level of one or more sidelobes of the antenna device, change a direction of a strongest sidelobe of the antenna device, increase a uniformity of a radiation profile in the near-field, and/or minimize a peak value of field amplitudes in the near-field. The system may utilize a minimax approximation algorithm to minimize a peak value of field amplitudes in the near-field.

Determining the optimized $\{z_n\}$ of impedance values for each of the lumped antenna ports, $N_a$, may include determining an optimized set of control values for the plurality of impedance control inputs that results in an field amplitude for the at least one lumped external port, $N_e$, in the S-Matrix that approximates the target field amplitude for a given operating frequency or frequency range.

In conformity with the antenna systems and associated methods described above, a plurality of lumped antenna ports, $N_a$, with impedance values corresponding to the impedance values of each of the plurality of lumped impedance elements may be considered jointly with one or more external ports, $N_e$, whose purpose is to account for the field intensity at a particular location exterior to the antenna system. The external port, $N_e$, may represent an actual receive antenna, in which case a known input impedance of that port may be assigned to the external port, $N_e$. In other embodiments, the one or more external ports, $N_e$, may be merely conceptual and used to quantify one or more field intensities at one or more locations. The external port, $N_e$, may be assumed infinitesimal in area and/or volume and located at a particular radius-vector $\vec{r}_0$.

Regardless of the number of external ports, $N_e$, the total number of ports N will correspond to the number of lumped antenna ports, $N_a$, and the number of external ports, $N_e$. In some embodiments, a common port (e.g., a waveguide or TL) associated with the antenna system may also be considered. In any such embodiments, the total size of the system matrices will be generally of size N, which does not grow exponentially with the degrees of freedom or number of variable impedance elements.

The S-Matrix element $S_{1N}$ represents the complex magnitude of field (e.g., electric field) at a particular location in space, given by the radius vector $\vec{r}_0$, normalized to the field magnitude at the input port. The absolute value $|S_{1N}|$, or the more algebraically convenient quantity $|S_{1N}|^2$, quantifies the quality of field concentration at that point. Maximizing this quantity (or minimizing in the case of forming nulls) represents a generalized beamforming algorithm.

In some embodiments, the location $\vec{r}_0$, is in the far-field of the rest of the system, and the algorithm yields directive beams in the far-field. In other embodiments, the point $\vec{r}_0$ is in the radiative near-field of the rest of the system, and the algorithm yields field focusing to that point. In still other embodiments, the point $\vec{r}_0$ is within the reactive near-field of at least one part of the rest of the system, and the algorithm maximizes electric field intensity and electric energy density at that point.

To find all local optima and the global optimum we can use the equation $q_n \equiv \sqrt{z_n}$, which characterizes the individual port impedances $z_n$. The equation above, $S=U^{\backslash}(1-\zeta Y_d\zeta)(1+\zeta Y_d\zeta)^{-1}U$, is a rational (and meromorphic) analytical function of $\{q_n\}$.

To make this function bounded, and find its maxima that are attainable in a passive system, the function may be restricted to the multidimensional segment satisfying $\mathrm{Re}(z_n)\geq 0$, n=1, . . . , N. Equivalently, this condition is $-\pi/2\leq \arg z_n\leq \pi/2$, and consequently $-\pi/4\leq \arg q_n\leq \pi/4$.

To reduce this problem to real values, each $q_n$ variable can be expressed through real variables, $q_n=\rho_n+i\xi_n$. In this manner, the real valued function $|S_{1N}|^2$ is now a function of 2N real variables $\rho_n,\xi_n$, which is a rational function comprising a ratio of two 2N-variate polynomials.

In some embodiments, the resistance of each lumped element can be neglected by assuming $\mathrm{Re}(z_n)=0$, $z_n=ix_n$, with the real reactance values $x_n$. In such embodiments, the system as a whole is still assumed passive and lossy with the losses occurring on the paths between the ports and incorporated into the Z-Matrix (or Y-Matrix). This approximation satisfies the passivity constraints and also reduces the number of variables to N because $\sqrt{z}Y\sqrt{z}\rightarrow i\sqrt{x}Y\sqrt{x}$, and x is purely real.

The function $|S_{1N}|^2$ is necessarily bounded for a passive system, and therefore it has a finite global maximum as a function of real-valued variables $\rho_n,\xi_n$. Moreover, it has a finite number of local extrema. These extrema can be found by solving a set of 2N multivariate polynomial equations given by the standard zero gradient condition at the extremum:

$$\frac{\partial|S_{1N}|^2}{\partial\rho_n}=0,\ \frac{\partial|S_{1N}|^2}{\partial\xi_n}=0,$$

n=1, . . . , N.

In the simplified approach above, there are N unknowns $\chi_n=\sqrt{x_n}$ and N extremum conditions, so $$\frac{\partial|S_{1N}|^2}{\partial\chi_n}=0,$$

n=1, . . . , N.

Once these extrema are found, the extremal values of the function are evaluated numerically, and the global maximum is determined by choosing the largest local maximum. A similar approach can be performed to identify one or more minimums to attain a target radiation pattern with a null at one or more specific radius vectors $\vec{r}_0$.

Numerical and symbolic-manipulation algorithms exist that take advantage of the polynomial nature of the resulting equations. For example, Wolfram Mathematica™ function Maximize supports symbolic solving of the global optimization problem for multivariate polynomial equations, unconstrained or with multivariate polynomial constraints. This function is based on a Groebner-basis calculation algorithm, which reduces the multidimensional polynomial system to a triangular system, which is then reduced to a single scalar polynomial equation by back-substitution. Similar functionality exists in other software packages, including MATLAB™ with Symbolic Math Toolbox™, Maple™ and so on.

As previously discussed, once values are determine for each of the $z_n$ for the variable or tunable lumped impedance elements associated with the sub-wavelength antenna elements, each of the impedance elements can be tuned. In some embodiments, the tuning is static and the impedance values are set at the manufacturing stage. In other embodiments, a physical stimulus (e.g., mechanical, electric, electromagnetic, and/or a combination thereof) may be used to dynamically tune impedance elements to dynamically modify the radiation pattern of the antenna system during operation.

Depending on the manufacturing techniques employed (e.g., 3D printing) the calculated values of optimum impedance values may translate trivially into the choices made for the selectable impedance elements. In contrast, for the dynamically adjustable, variable, or tunable impedance elements, there is generally a non-trivial relationship between the complex impedance of the elements and the stimuli that control them. In some embodiments, the relationship between the complex impedance of the impedance elements and the control inputs may be based on a magnitude of an applied signal. Appreciating that the magnitude of the stimulus may be binary in some embodiments (i.e., on or off), the relationship may be modeled as $z_n=f_n(s_n)$, where $s_n$, is the real-valued magnitude of the stimulus. The function $f_n(s_n)$ can be fitted with a polynomial order S, and substituted into $|S_{1N}|^2$. The functions $f_n$ can be all the same when identical dynamically tunable elements are used, in which case there will be N extremum conditions for N real variables $s_n$, each of which is still a rational function.

In the lowest-order approximation, the fitting polynomial can be linear (S=1), in which case the complexity of the extremum problem is still $$\frac{\partial|S_{1N}|^2}{\partial\chi_n}=0,$$

n=1, . . . , N. The quality of a polynomial approximation depends greatly on the practically available range of the stimulus, or the range chosen for other practical considerations. Because the $s_n$ variables are restricted to a finite interval, the optimization problem can be solved with the corresponding constraints. When the optimization problem is solved by exhaustive enumeration of the extrema, these constrains are applied trivially and the local extrema not satisfying the constraints are excluded from the enumeration.

A wide range of adaptive beamforming applications are contemplated and made possible using the systems and methods described herein. For example, in some embodiments, beamforming may include a multipath propagation channel involving one or more reflective, refractive, or generally scattering object. In many embodiments, the relevant properties of the multipath propagation channel are incorporated into the Z-Matrix. Numerical simulations that lead to a calculation of the Z-Matrix may include a model of such a channel. A model of the multipath propagation channel can be simulated using any of a wide variety of simulation software packages, including, for example, ANSYS® HFSS®, COMSOL® RF, CST® MWS®, etc.

In some embodiments, a particular linear field polarization can be achieved by considering the output port to be a port susceptible to only one linear polarization. For instance, a lumped (electrically small, single-mode) port is susceptible to a linear polarization with the electric field directed across the gap of the port.

In some embodiments, a target radiation pattern may be identified that includes a combination of two linear polarizations, including without limitation a circular polarization, that can be achieved by considering two co-located output ports, each of which is susceptible to only one linear polarization. In such an embodiment, the system matrices may be slightly increased by the addition of more external ports, $N_e$, but the addition of a few external ports increases the complexity by a relatively small constant value and will not change the general course of the algorithms and methods described herein.

In some embodiments, multiple beams can be formed simultaneously (the process known as multi-beam forming) by considering M output ports located in different directions with respect to the rest of the system. The size of the system matrices may then correspond to N=Na+M+1, which does not change the general course of the algorithm and does not exponentially increase the complexity.

As previously discussed, approximate nulls of the field can be formed, either in the far-field or near-field, by considering a minimization problem for the rational function of the equations above. Similarly, a required level of sidelobe suppression for a target radiation pattern can be attained by maximizing the function $F=|S_{1N}|^2-\alpha|S_{1,N+1}|^2$, where the $N^{th}$ port measures the field intensity in one direction, the $(N+1)^{th}$ port measures field intensity in a specified sidelobe direction, and a is a selectable weight coefficient reflecting the degree to which sidelobe suppression should be achieved. It is appreciated that the equation above can be readily generalized to include any number of sidelobes in any number of directions. Thus, it is appreciated that instead of optimizing the impedance values themselves, a function relating the impedance control inputs to the impedance values of the variable (i.e., tunable) impedance elements may be substituted into the equations to allow for the direct optimization of the impedance control inputs.

FIG. 1 is a flow chart of one embodiment of a method for radiation patterning by optimizing impedance values associated with an S-Matrix that includes at least one lumped port external to an antenna system. The method illustrated may be computer-implemented via software and a processor or microprocessor. In other embodiments, the method may be implemented using an application specific integrated circuit, a field-programmable gate array, other hardware circuitry, integrated circuits, software, firmware, and/or a combination thereof. As illustrated, an S-Matrix may be determined that includes field amplitudes for each of a plurality of lumped ports, N, associated with an antenna device, at 110.

The N lumped ports may include a plurality of lumped antenna ports, $N_a$, wherein each lumped antenna port corresponds to an impedance value of a lumped impedance element in communication with at least one sub-wavelength antenna element of an antenna device, wherein the impedance value of each of the lumped impedance elements is variable based on one or more impedance control inputs, and at least one lumped external port, $N_e$, located physically external to the antenna device. In various embodiments, the S-Matrix may be expressible in terms of an impedance matrix, Z-Matrix, with impedance values, $z_n$, of each of the plurality of lumped ports, N.

Once the S-Matrix has been determined, a target radiation pattern of the antenna device may be defined in terms of target field amplitudes in the S-Matrix for the at least one lumped external port, $N_e$, at 120. An optimized port impedance vector, $\{z_n\}$, of impedance values for each of the lumped antenna ports, $N_a$, may then be determined, at 130, that results in an S-Matrix element for the at least one lumped external port, $N_e$, that approximates the target field amplitude for an operating frequency or operating frequency range.

Figure 2:
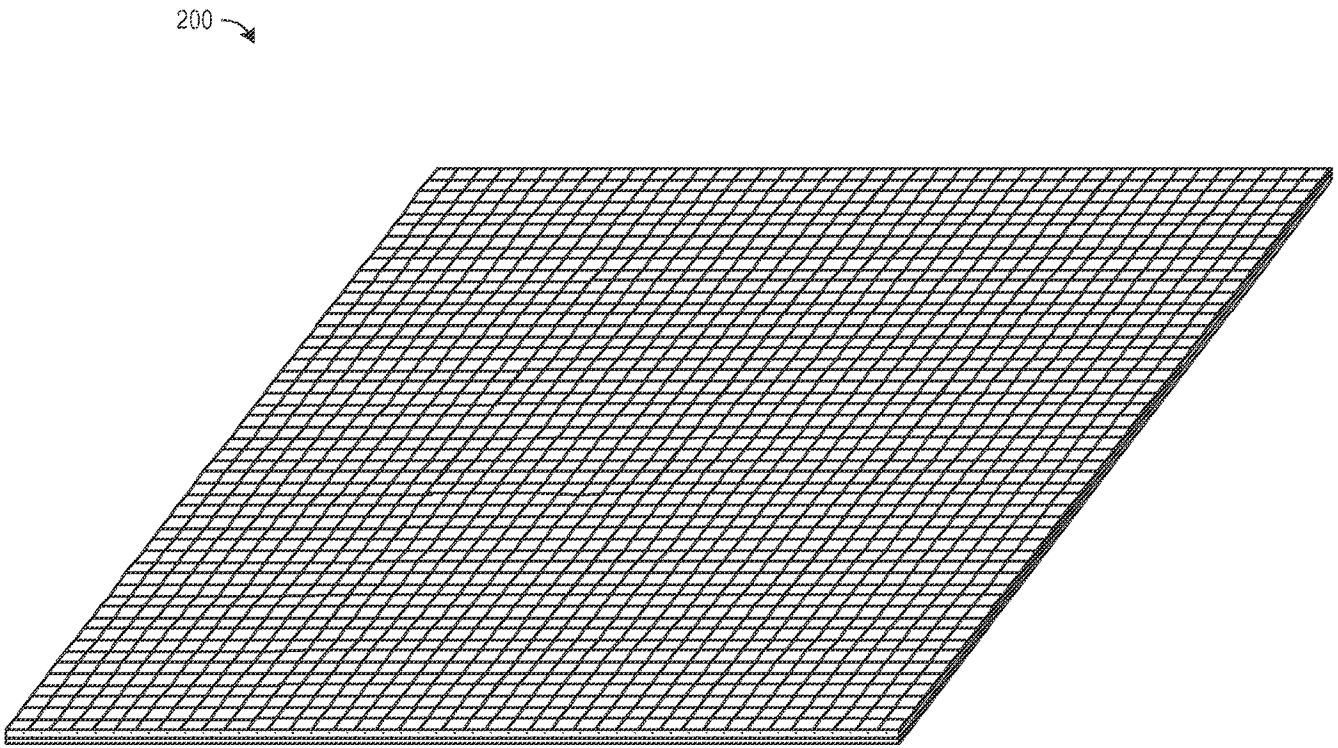
FIG. 2 illustrates an antenna system comprising an array of sub-wavelength antenna elements, according to one simplified embodiment.

FIG. 2 illustrates an antenna system comprising an array of sub-wavelength antenna elements 200, according to one simplified embodiment. The sub-wavelength antenna elements 200 may be associated with a plurality of variable or tunable impedance elements.

Figure 3A:
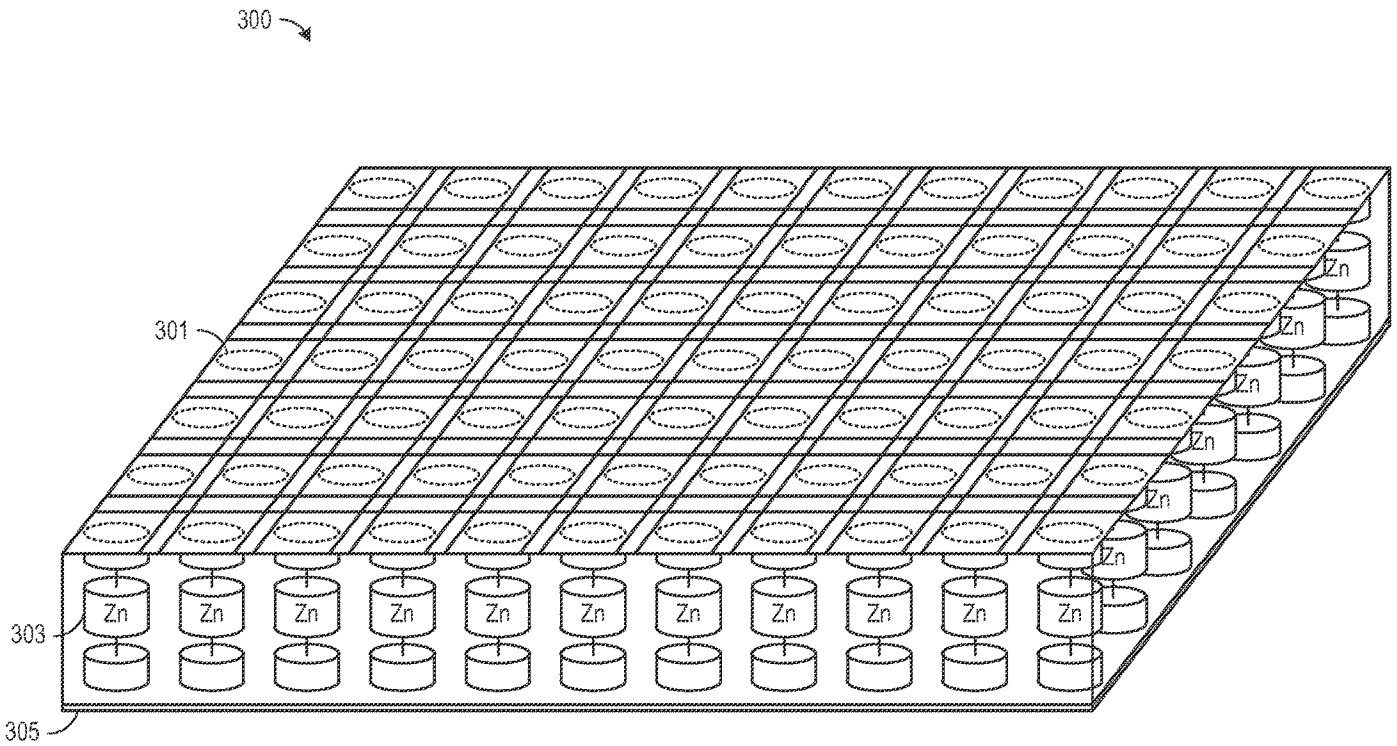
FIG. 3A illustrates a close-up view of a section of an array of sub-wavelength antenna elements with associated variable impedance elements, according to one simplified embodiment.

FIG. 3A illustrates a conceptual model of an antenna system 300 showing a section of an array of sub-wavelength antenna elements 301 with associated variable lumped impedance elements, $z_n$, 303 according to a simplified embodiment. As previously described, the sub-wavelength antenna elements 301 may have inter-element spacings that are substantially less than a free-space wavelength corresponding to an operating frequency or frequency range of the antenna system 300. For example, the inter-element spacings may be less than one-half or one-quarter of the free-space operating wavelength. As shown, each of the sub-wavelength antenna elements 301 is associated with at least one lumped impedance element 303. A common TL 305 may be coupled to the sub-wavelength antenna elements via the lumped impedance elements and may be modeled as another lumped impedance element or may be incorporated based on the effects of the TL 305 or other common waveguide on each of the lumped impedance elements 303. Each lumped impedance element 303 may have a variable impedance value that is set during manufacture or that can be dynamically tuned via one or more control inputs. The 1:1 ratio of lumped impedance elements 303 and sub-wavelength antenna elements 301 is merely exemplary and other ratios are possible.

Figure 3B:
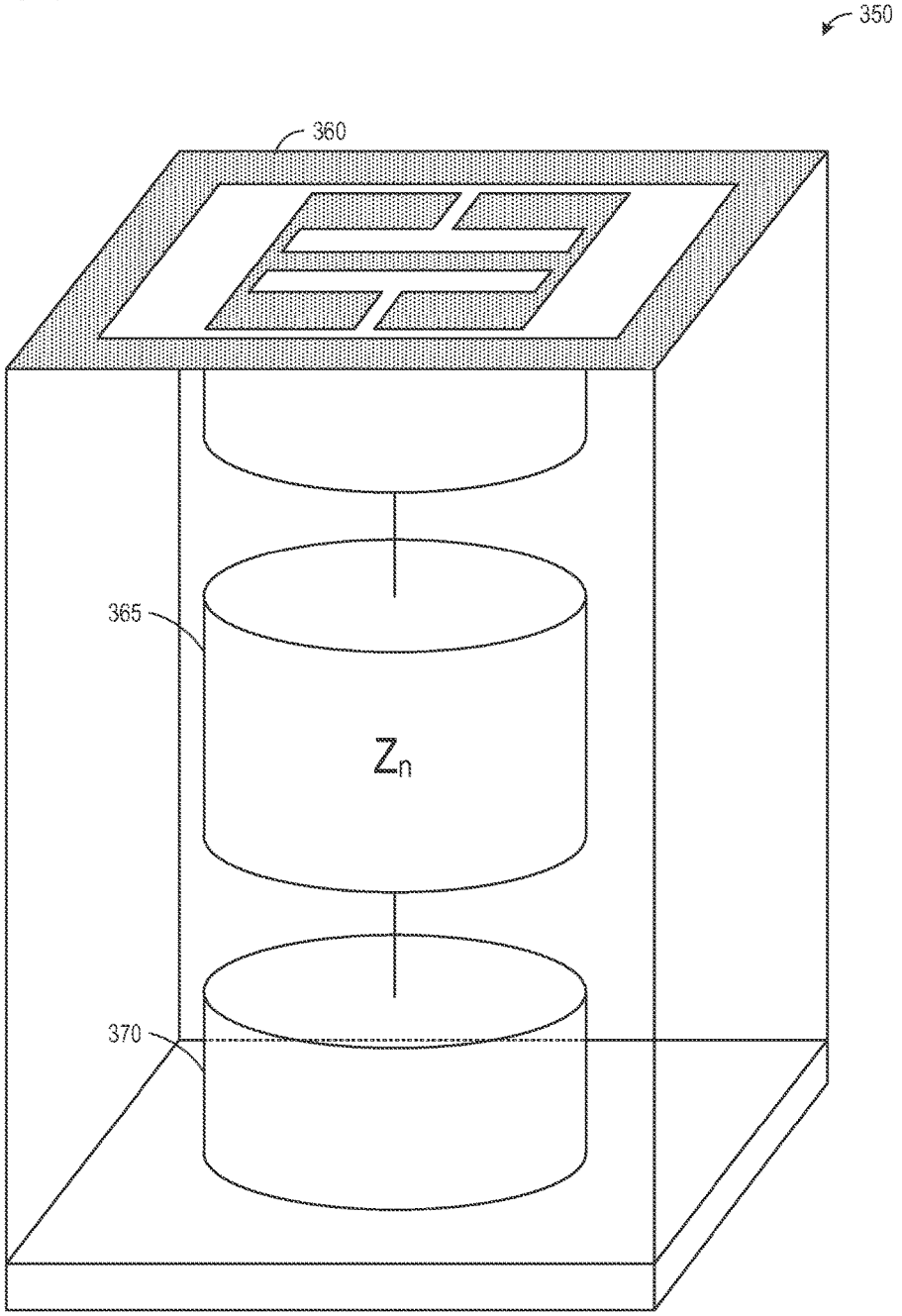
FIG. 3B illustrates a view of a conceptual model of a single sub-wavelength antenna element with an associated impedance element, according to one simplified embodiment.

FIG. 3B illustrates a close-up view 350 of a model of a single sub-wavelength antenna element 360 with an associated lumped impedance element, $z_n$, 365, and an impedance control input 370 that can be used to control or vary the impedance of the lumped impedance element, $z_n$, 365, according to one simplified embodiment.

Figure 4A:
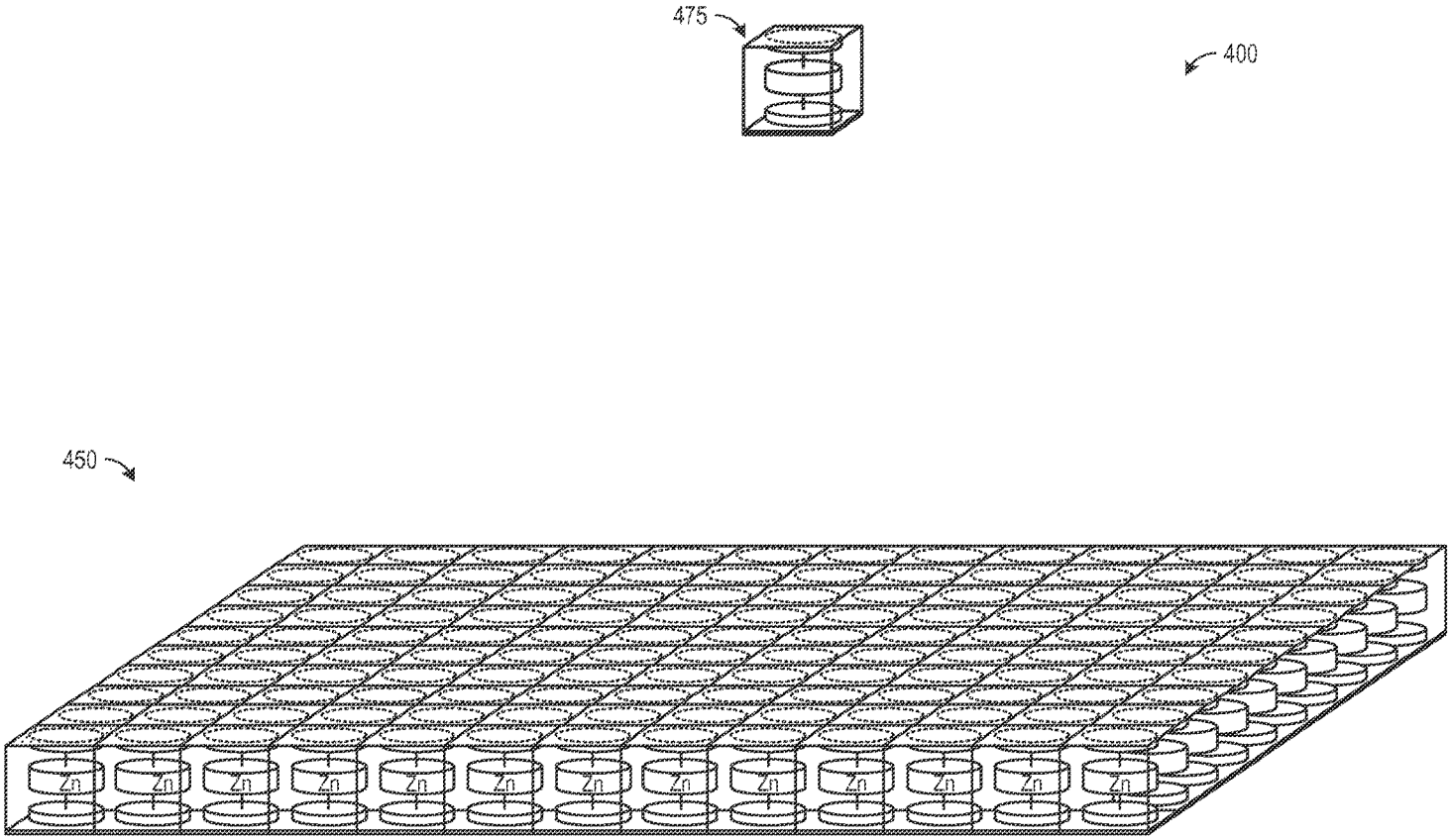
FIG. 4A illustrates an array of sub-wavelength antenna elements and associated variable impedance elements modeled as lumped ports, $N_a$, in an S-Matrix with a single external port, $N_e$, located physically external to the antenna system, according to one simplified embodiment.

FIG. 4A illustrates an array of sub-wavelength antenna elements 450 and associated variable lumped impedance elements with variable impedances $z_n$, modeled as lumped ports, $N_a$, in an S-Matrix with a single external port, $N_e$, 475 that is located physically external to the antenna system 450, according to one simplified embodiment.

In various embodiments, the modeled lumped external port, $N_e$, 475 may be associated with a variable impedance element, as illustrated. In some embodiments, the lumped external port, $N_e$, 475 is modeled as an external port with an infinitesimal volume located at a particular radius-vector relative to the antenna device. The lumped external port, $N_e$, 475 may be in the far-field of the antenna device, the radiative near-field of the antenna device, or the reactive near-field of the antenna device.

In some embodiments, the lumped external port, $N_e$, 475 may comprise a virtual port, an external region of space assumed to be a void, a region of space assumed to be filled with a dielectric material, and/or a location in space assumed to be filled with a conductive, radiative, reactive, and/or reflective material. In at least some embodiments, the lumped external port, $N_e$, 475 comprises or corresponds to the location of a receiving antenna or portion thereof.

Figure 4B:
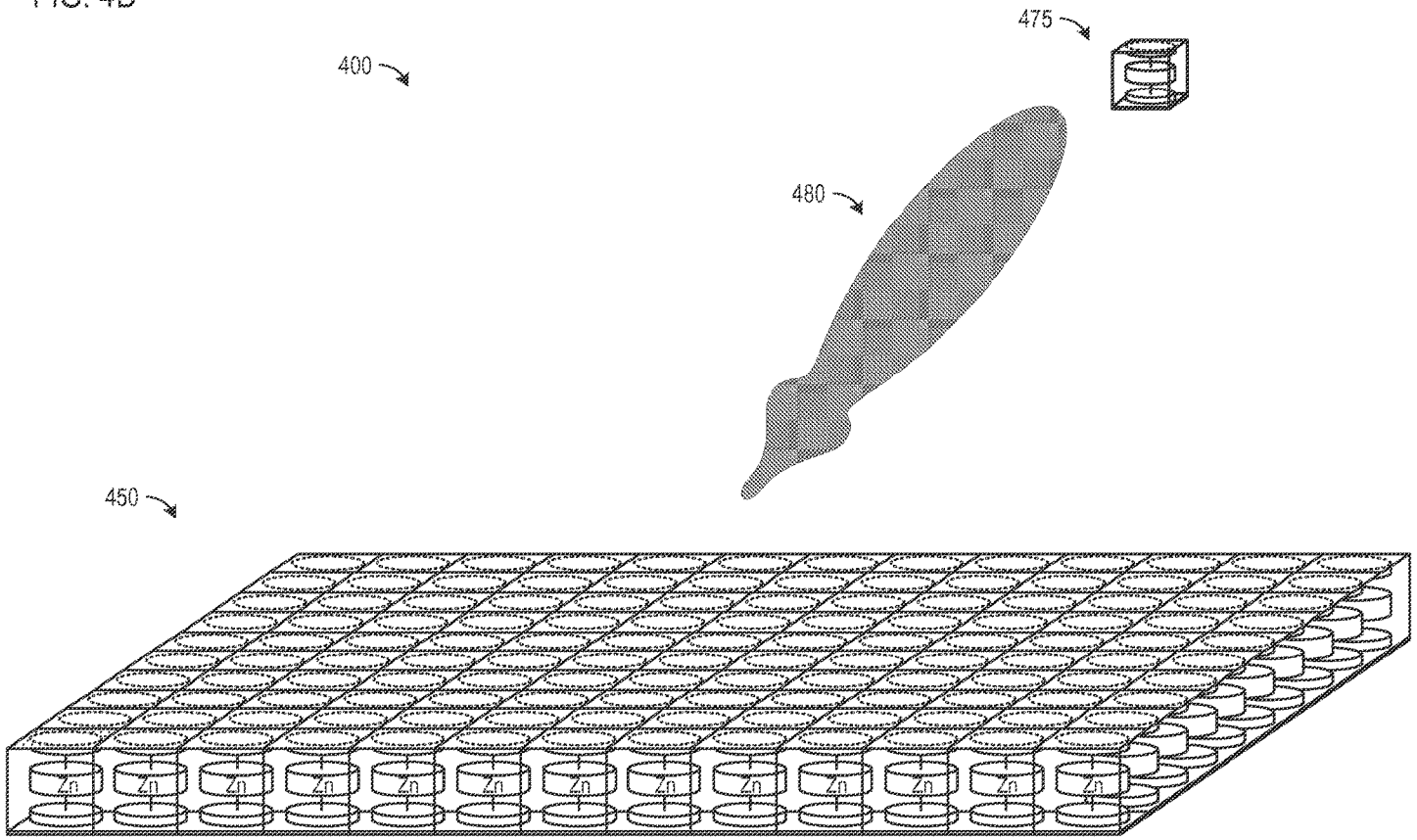
FIG. 4B illustrates a radiation pattern formed to maximize a field amplitude of an S-Matrix element associated with an external port, $N_e$, located physically external to the antenna system by adjusting the impedance values associated with each of the lumped ports, $N_a$, defined by the sub-wavelength antenna elements and associated impedance elements, according to one embodiment.

FIG. 4B illustrates a radiation pattern 480 formed to maximize a field amplitude of an S-Matrix element associated with an external port, $N_e$, 475 located physically external to the antenna system by adjusting the impedance values, $z_n$, associated with each of the lumped ports, $N_a$, defined by the sub-wavelength antenna elements and associated lumped impedance elements in the antenna system 450, according to one embodiment.

Figure 4C:
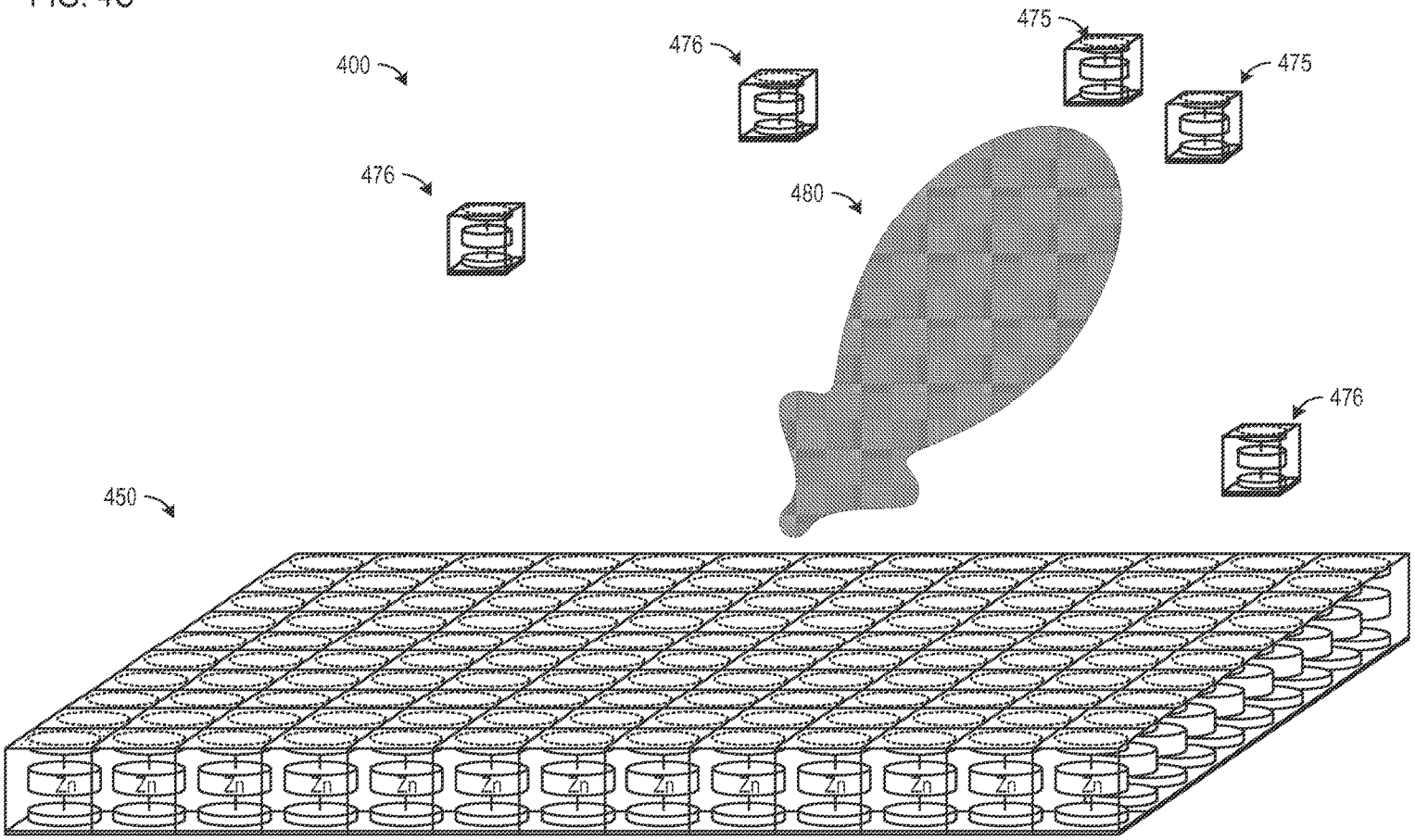
FIG. 4C illustrates a radiation pattern formed to maximize a field amplitude of S-Matrix elements associated with two external ports, $N_e$, located physically external to the antenna system and by minimizing the field amplitude of three other external ports $N_e$, according to one embodiment.

FIG. 4C illustrates a radiation pattern 480 formed to maximize a field amplitude of S-Matrix elements associated with two external ports, $N_e$, 475 located physically external to the antenna system and by minimizing the field amplitude of three other external ports, $N_e$, 476 according to one embodiment.

Figure 5A:
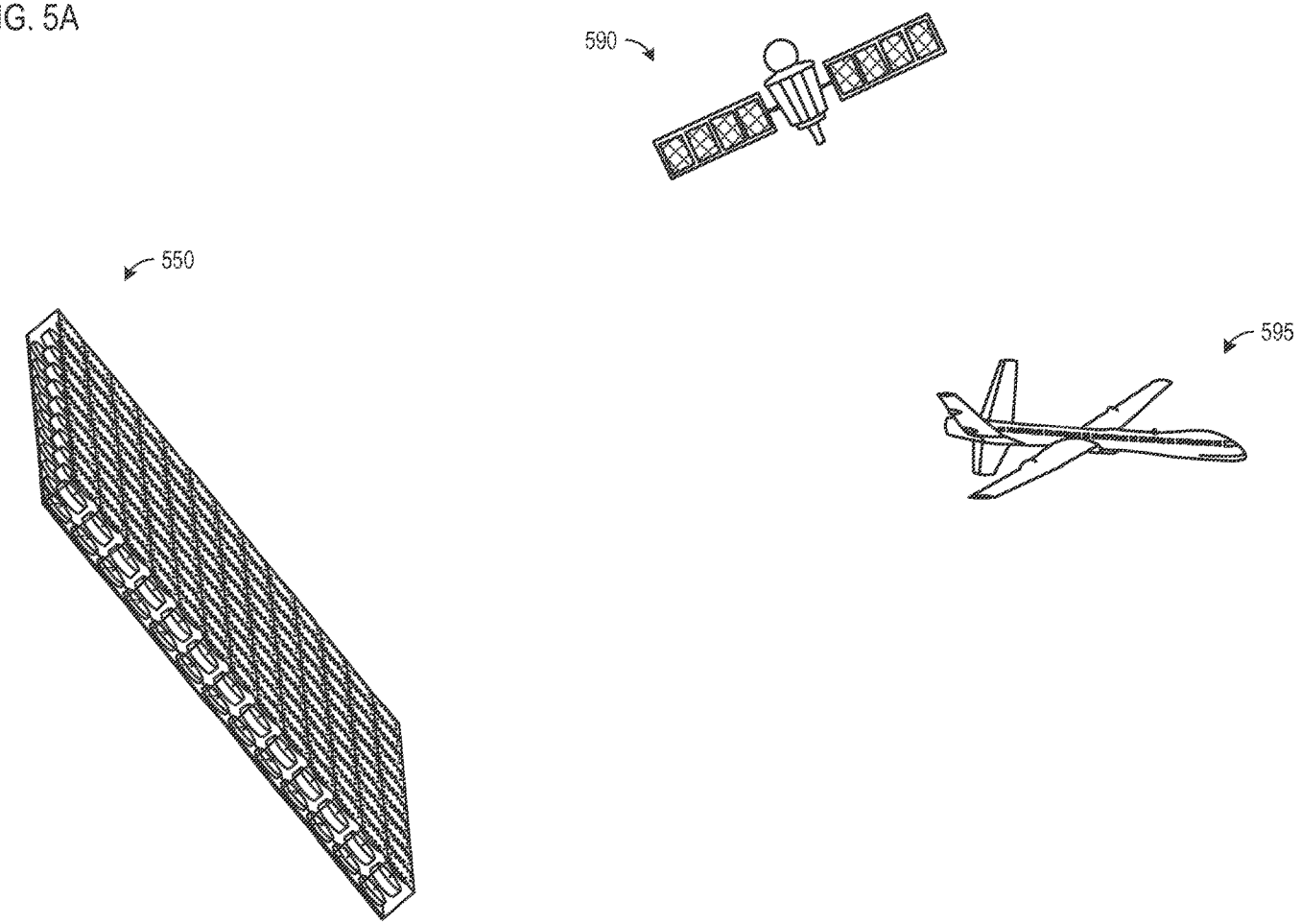
FIG. 5A illustrates an antenna system comprising an array of sub-wavelength antenna elements and associated variable impedance elements with two intended targets for radiation patterning.

FIG. 5A illustrates an antenna system 550 comprising an array of sub-wavelength antenna elements and associated variable impedance lumped elements with two intended targets 590 and 595 for radiation patterning.

Figure 5B:
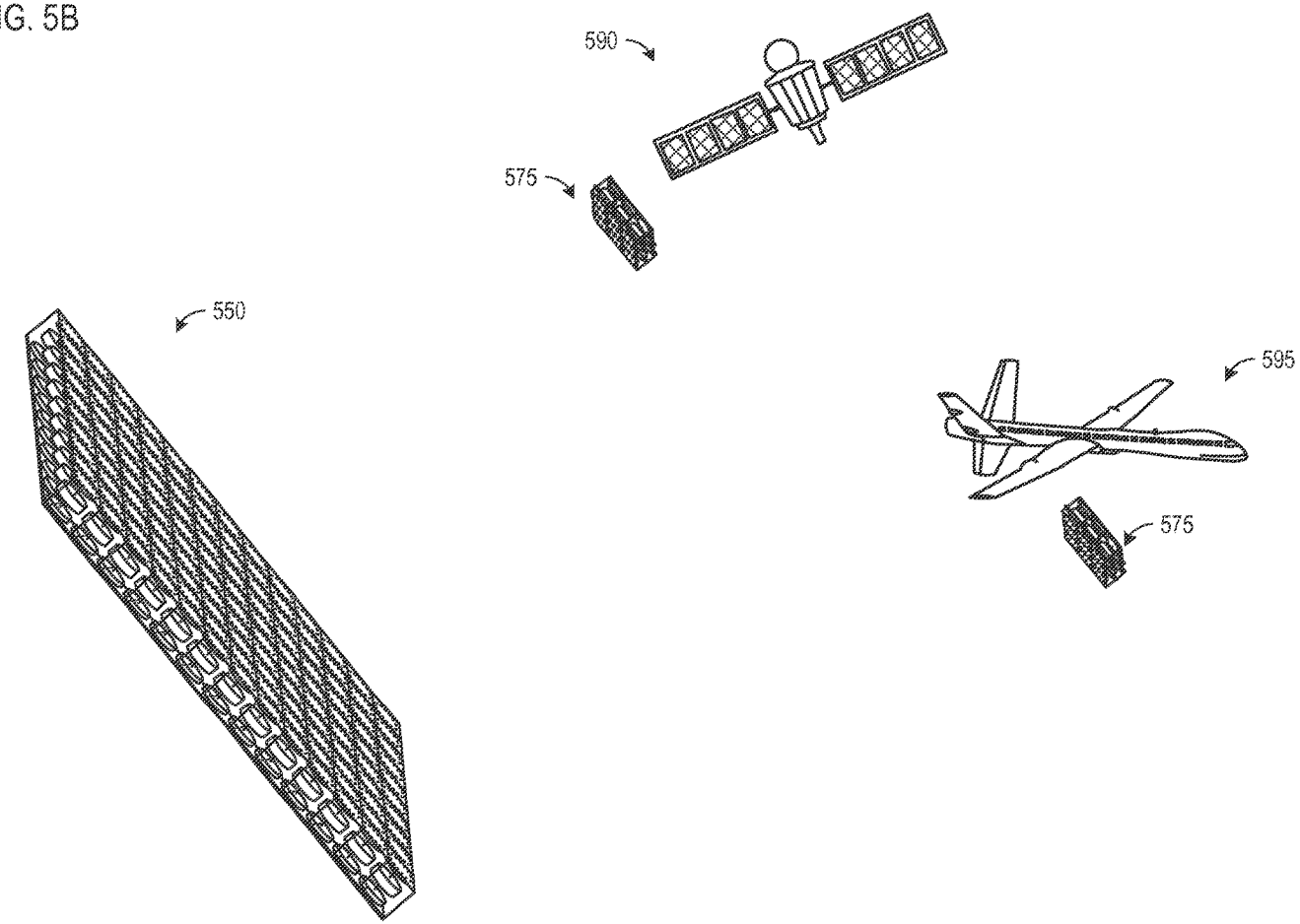
FIG. 5B illustrates one embodiment showing the modeling of the antenna system in an S-Matrix of field amplitudes of a plurality of ports, N, including lumped antenna ports, $N_a$, and two lumped external ports, $N_e$.

FIG. 5B illustrates an embodiment showing the modeling of the antenna system in an S-Matrix of field amplitudes of a plurality of ports, N, including lumped antenna ports, $N_a$, of the sub-wavelength antenna elements and associated variable impedance elements 550 and two lumped external ports, $N_e$, 575.

As previously described, multiple beams can be formed simultaneously or in switch-mode by considering M output ports (e.g., the two different external ports, $N_e$, 575) located in different directions and potentially very distant from one another. The size of the system matrices that must be optimized may then correspond to N=Na+M−1, but again, this does not change the general course of the algorithm nor does this increase the complexity exponentially.

As previously discussed, approximate nulls of the field can be formed, either in the far-field or near-field, by considering a minimization problem for the rational functions described in detail above. To attain a specific target radiation patter, a required level of sidelobe suppression can be attained by maximizing the function $F=|S_{1N}|^2-\alpha|S_{1,N+1}|^2$, where the $N^{th}$ port measures the field intensity in one direction, the (N−1) port measures field intensity in a specified sidelobe direction, where $\alpha$ is a selectable weight coefficient reflecting the degree to which sidelobe suppression should be achieved.

Figure 5C:
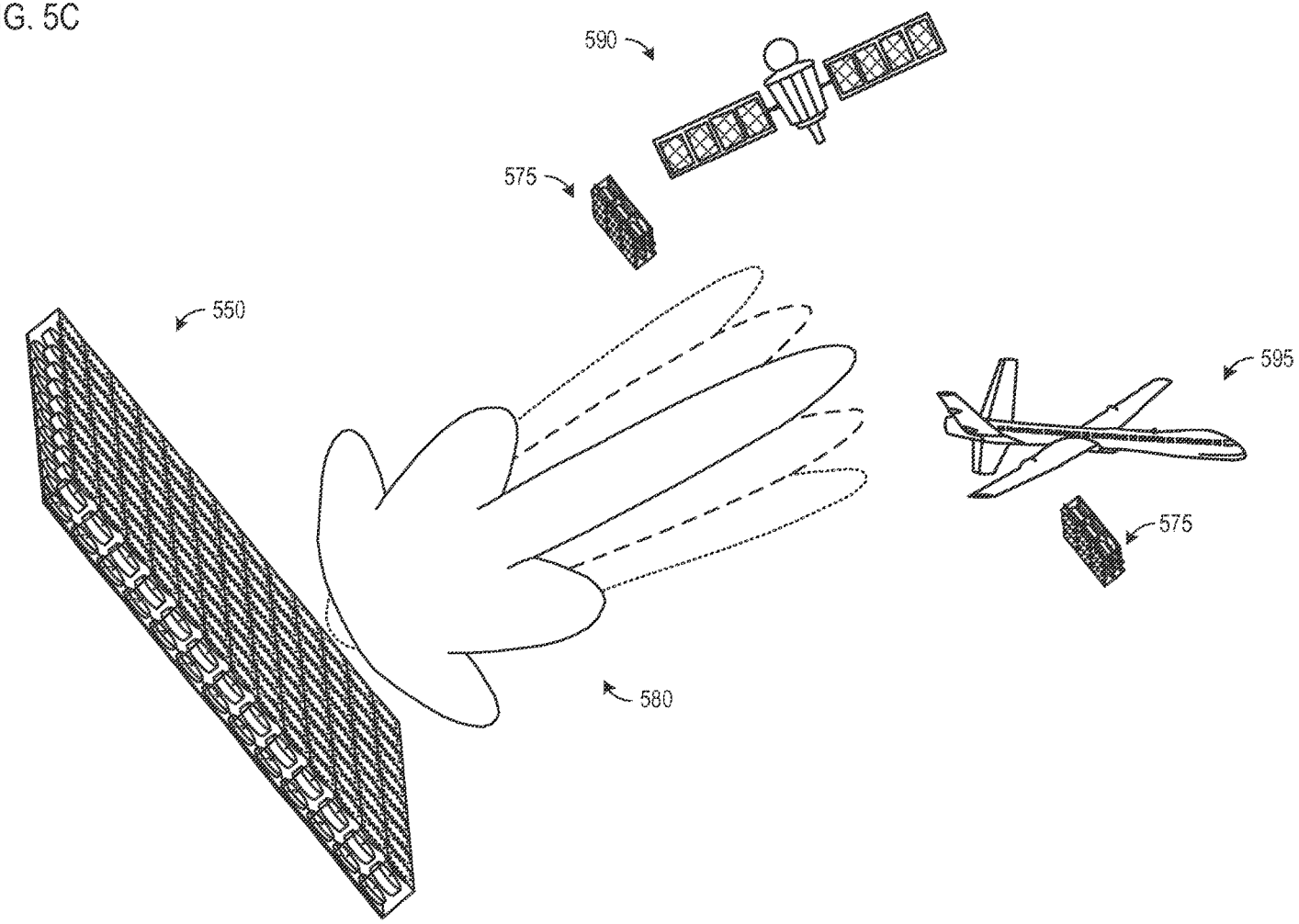
FIG. 5C graphically illustrates the results of adjusting one or more variable impedance control inputs to modify one or more impedance values of one or more of the variable impedance elements to attain a desired radiation pattern, according to one embodiment.

FIG. 5C graphically illustrates the results of adjusting one or more variable impedance control inputs to modify one or more impedance values of one or more of the variable lumped impedance elements associated with the sub-wavelength antenna elements of the antenna system 550 to attain a desired radiation pattern 580 based on the two lumped external ports, $N_e$, 575, and the associated targets 590 and 595.

Many existing computing devices and infrastructures may be used in combination with the presently described systems and methods. Some of the infrastructure that can be used with embodiments disclosed herein is already available, such as general-purpose computers, computer programming tools and techniques, digital storage media, and communication links. A computing device or controller may include a processor, such as a microprocessor, a microcontroller, logic circuitry, or the like.

A processor may include a special purpose processing device, such as application-specific integrated circuits (ASIC), programmable array logic (PAL), programmable logic array (PLA), programmable logic device (PLD), field programmable gate array (FPGA), or other customizable and/or programmable device. The computing device may also include a machine-readable storage device, such as non-volatile memory, static RAM, dynamic RAM, ROM, CD-ROM, disk, tape, magnetic, optical, flash memory, or other machine-readable storage medium. Various aspects of certain embodiments may be implemented using hardware, software, firmware, or a combination thereof.

The components of the disclosed embodiments, as generally described and illustrated in the figures herein, could be arranged and designed in a wide variety of different configurations. Furthermore, the features, structures, and operations associated with one embodiment may be applicable to or combined with the features, structures, or operations described in conjunction with another embodiment. In many instances, well-known structures, materials, or operations are not shown or described in detail to avoid obscuring aspects of this disclosure.

The embodiments of the systems and methods provided within this disclosure are not intended to limit the scope of the disclosure, but are merely representative of possible embodiments. In addition, the steps of a method do not necessarily need to be executed in any specific order, or even sequentially, nor do the steps need to be executed only once. As described above, descriptions and variations described in terms of transmitters are equally applicable to receivers, and vice versa.

This disclosure has been made with reference to various exemplary embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element. The scope of the present invention should, therefore, be determined by the following claims.

What is claimed is:

1. An antenna system, comprising:

a plurality of sub-wavelength antenna elements;

a plurality of lumped impedance elements in communication with the plurality of sub-wavelength antenna elements;

a plurality of variable impedance control inputs configured to allow for the selection of an impedance value for each of the lumped impedance elements;

a processor; and a computer-readable medium providing instructions accessible to the processor to cause the processor to perform operations for radiation patterning, comprising:

determining a scattering matrix (S-Matrix) of field amplitudes for each of a plurality of lumped ports, N, wherein the lumped ports, N, include:

a plurality of lumped antenna ports, $N_a$, with impedance values corresponding to the impedance values of each of the plurality of lumped impedance elements; and at least one lumped external port, $N_e$, located physically external to the antenna system, wherein the S-Matrix is expressible in terms of an impedance matrix, Z-Matrix, with impedance values, $z_n$, of each of the plurality of lumped ports, N;

identifying a target radiation pattern of the antenna system defined in terms of target field amplitudes in the S-Matrix for the at least one lumped external port, $N_e$;

determining an optimized port impedance vector $\{z_n\}$ of impedance values $z_n$ for each of the lumped antenna ports, $N_a$, that results in an S-Matrix element for the at least one lumped external port, $N_e$, that approximates the target field amplitude for an operating frequency; and adjusting at least one of the plurality of variable impedance control inputs to modify at least one of the impedance values of at least one of the plurality of variable lumped impedance elements based on the determined optimized $\{z_n\}$ of the impedance values for the lumped antenna ports, $N_a$.

2. The system of claim 1, wherein each of the sub-wavelength antenna elements comprises an antenna element with a maximum dimension that is less than half of a wavelength of the smallest frequency in an operating frequency range.

3. The system of claim 1, wherein at least some of the sub-wavelength antenna elements comprise resonating elements.

4. The system of claim 1, wherein at least two of the sub-wavelength antenna elements comprise a metamaterial.

5. The system of claim 1, further comprising a common transmission line (TL) coupled to the lumped impedance elements.

6. The system of claim 1, wherein the at least one lumped external port, $N_e$, comprises a virtual external port.

7. The system of claim 1, wherein the at least one lumped external port, $N_e$, comprises a receiving antenna associated with an external device.

8. The system of claim 1, wherein each lumped impedance element is associated with a unique impedance control input, such that the impedance value of each lumped impedance element is independently variable.

9. The system of claim 1, wherein the impedance control input associated with at least one of the lumped impedance elements comprises a direct current (DC) voltage input, wherein the impedance value of the at least one lumped impedance element is based on the magnitude of the voltage supplied via the DC voltage input.

10. The system of claim 1, wherein the impedance control input associated with at least one of the lumped impedance elements can be varied to adjust the impedance value of the at least one lumped impedance element, wherein the impedance control input comprises one of: an electrical current input, a radiofrequency electromagnetic wave input, an optical radiation input, a thermal radiation input, a terahertz radiation input, an acoustic wave input, a phonon wave input, a thermal conduction input, a mechanical pressure input and a mechanical contact input.

11. The system of claim 1, wherein the impedance value of at least one of the lumped impedance elements is variable based on one or more electrical impedance control inputs.

12. The system of claim 1, wherein the impedance value of at least one of the lumped impedance elements is variable based on one or more mechanical impedance control inputs.

13. The system of claim 1, wherein at least one of the lumped impedance elements comprises one or more of a resistor, a capacitor, an inductor, a varactor, a diode, and a transistor.

14. The system of claim 1, wherein each of the sub-wavelength antenna elements have inter-element spacings substantially less than a free-space wavelength corresponding to the operating frequency.

15. The system of claim 1, wherein the at least one lumped external port, $N_e$, comprises a plurality of lumped external ports all located external to the antenna device, and wherein the target field amplitudes in the S-Matrix of each of the plurality of lumped external ports correspond to a target radiation pattern of the antenna device for at least the operating frequency.

16. The system of claim 15, wherein each of the sub-wavelength antenna elements comprises an antenna element with a maximum dimension that is less than half of a wavelength of the smallest frequency in an operating frequency range.

17. The system of claim 15, wherein at least some of the sub-wavelength antenna elements comprise resonating metamaterial elements.

18. A method for antenna radiation patterning, comprising:

numerically evaluating a scattering matrix (S-Matrix) of field amplitudes for each of a plurality of lumped ports, N, associated with an antenna device, including a plurality of lumped antenna ports, $N_a$, wherein each lumped antenna port corresponds to an impedance value of a lumped impedance element in communication with at least one sub-wavelength antenna element of an antenna device, and at least one lumped external port, $N_e$, located physically external to the antenna device, wherein the S-Matrix is expressible in terms of an impedance matrix, Z-Matrix, with impedance values, $z_n$, of each of the plurality of lumped ports, N;

identifying a target radiation pattern of the antenna device defined in terms of target field amplitudes in the S-Matrix for the at least one lumped external port, $N_e$; and determining an optimized port impedance vector, $\{z_n\}$, of impedance values for each of the lumped antenna ports, $N_a$, that results in an S-Matrix element for the at least one lumped external port, $N_e$, that approximates the target field amplitude for an operating frequency;

wherein each of the lumped impedance elements is tunable, such that an impedance value of each of the tunable, lumped impedance elements is variable based on a plurality of impedance control inputs, and wherein the method further comprises:

adjusting impedance values of at least some of the tunable, lumped impedance elements based on the determined optimized impedance matrix.

19. The method of claim 18, wherein the impedance value of each of the lumped impedance elements is variable based on one or more impedance control inputs.

20. The method of claim 18, wherein each lumped impedance element is associated with a unique dielectric loading, such that the impedance value of each lumped impedance element is independently selectable.

21. The method of claim 20, wherein the dielectric material comprises at least one material printed using a 3D printer and the dielectric value is selected based on a filling fraction of the at least one 3D-printed material.

22. The method of claim 20, wherein the dielectric material comprises at least one material printed using a 3D printer and the dielectric value is selected based on a dielectric constant of the at least one 3D-printed material.

23. The method of claim 20, wherein the dielectric material comprises a combination of at least two dielectric materials and the impedance value is based at least in part on the ratio of the two dielectric materials.

24. The method of claim 23, wherein the at least two dielectric materials are printed using a multi-material 3D printer and the dielectric value is selected based at least in part on a ratio of the at least two 3D-printed materials.

25. The method of claim 18, wherein each lumped impedance element is associated with a unique dielectric loading, such that the impedance value of each lumped impedance element is independently selectable.

26. The method of claim 18, wherein the at least one lumped external port, $N_e$, comprises a virtual external port.

27. The method of claim 26, wherein the virtual external port comprises a region of space assumed to be filled with a dielectric material.

28. The method of claim 26, wherein the virtual external port comprises an electrically conductive portion of an object located physically external to the antenna device.

29. The method of claim 18, wherein the at least one lumped external port, $N_e$, comprises a receiving antenna associated with an external device.

30. The method of claim 18, wherein each tunable, lumped impedance element is associated with a unique impedance control input, such that the impedance value of each tunable, lumped impedance element is independently variable.

31. The method of claim 30, wherein the impedance control input associated with at least one of the tunable, lumped impedance elements comprises a direct current (DC) voltage input, wherein the impedance value of the at least one tunable, lumped impedance element is based on the magnitude of the voltage supplied via the DC voltage input.

32. The method of claim 18, wherein at least one of the lumped impedance elements comprises one or more of a resistor, a capacitor, an inductor, a varactor, a diode, and a transistor.

33. The method of claim 18, wherein the target field magnitude in the S-Matrix for the at least one lumped external port, $N_e$, comprises a null in the field magnitudes of the target radiation pattern.

34. A method for manufacturing an antenna system, comprising:

determining a scattering matrix (S-Matrix) of field amplitudes for each of a plurality of lumped ports, N, associated with an antenna device, including a plurality of lumped antenna ports, $N_a$, wherein each lumped antenna port corresponds to an impedance value of a lumped impedance element in communication with at least one sub-wavelength antenna element of an antenna device, and at least one lumped external port, $N_e$, located physically external to the antenna device, wherein the S-Matrix is expressible in terms of an impedance matrix, Z Matrix, with impedance values, $z_n$, of each of the plurality of lumped ports, N;

identifying a target radiation pattern of the antenna device defined in terms of target field amplitudes in the S Matrix for the at least one lumped external port, $N_e$;

determining an optimized port impedance vector, $\{z_n\}$, of impedance values for each of the lumped antenna ports, $N_a$, that results in an S-Matrix element for the at least one lumped external port, $N_e$, that approximates the target field amplitude for an operating frequency; and forming a plurality of sub-wavelength antenna elements;

forming a plurality of impedance elements in communication with the plurality of sub-wavelength antenna elements with impedance values corresponding to the optimized impedance vector $\{z_n\}$.

35. The method of claim 34, wherein the impedance value of each of the impedance elements is variable based on one or more impedance control inputs.

* * * * *